US006688500B1

(12) United States Patent
Cheng

(10) Patent No.: US 6,688,500 B1
(45) Date of Patent: Feb. 10, 2004

(54) GROUT AND MORTAR BOTTLE

(76) Inventor: Dara Cheng, 2717 Preece St., San Diego, CA (US) 92111

( * ) Notice: Subject to any disclaimer, the term of this patent is extended or adjusted under 35 U.S.C. 154(b) by 0 days.

(21) Appl. No.: 10/126,888

(22) Filed: Apr. 19, 2002

(51) Int. Cl.[7] ..... B67D 3/00

(52) U.S. Cl. ..... 222/482; 220/210; 220/215; 220/466; 220/475; 220/568; 220/575

(58) Field of Search ..... 222/210, 212, 222/481, 465.1, 466, 475, 568, 575, 181.2, 181.3, 215, 478, 482

(56) References Cited

U.S. PATENT DOCUMENTS

| | | | | | |
|---|---|---|---|---|---|
| 2,729,505 | A | * | 1/1956 | Harvey | 239/327 |
| 2,928,533 | A | * | 3/1960 | Loucony | 206/375 |
| 3,165,241 | A | * | 1/1965 | Curry | 222/490 |
| 4,154,366 | A | * | 5/1979 | Acres | 222/212 |
| 4,452,381 | A | * | 6/1984 | Freeman | 222/465.1 |
| 4,469,250 | A | | 9/1984 | Evezich | |
| 5,275,311 | A | | 1/1994 | Piarrat | |
| 5,305,920 | A | | 4/1994 | Reiboldt et al. | |
| 5,529,213 | A | | 6/1996 | Mack | |
| 5,957,606 | A | | 9/1999 | Jafarmadar | |

* cited by examiner

*Primary Examiner*—Kevin Shaver
*Assistant Examiner*—Stephanie Willatt

(57) ABSTRACT

A grout and mortar bottle for convenient handling and application of viscous flowable substances, and may include three separate sections. The dispenser section may include a variety of nozzle and orifice designs. The main section includes an area to hold quantities of grout or mortar and includes a flexible section for squeezing the contents out through the dispensing section. A rear end cap is provided for loading the bottle. The cap includes a check valve to allow air to replace the expended mortar or grout and still provide for positive pressure for forcing the contents out the dispenser. The cap may also include a handle for manipulating the bottle or hanging the bottle in an attitude that maintains the bottle ready for use.

1 Claim, 4 Drawing Sheets

GROUT AND MORTAR BOTTLE

BACKGROUND OF THE INVENTION

1. Field of the Invention

The present invention relates to grout and mortar application tools and more particularly pertains to a new grout and mortar bottle for more convenient handling and application of grout and mortar.

2. Description of the Prior Art

The use of grout and mortar application tools is known in the prior art. More specifically, grout and mortar application tools heretofore devised and utilized are known to consist basically of familiar, expected and obvious structural configurations, notwithstanding the myriad of designs encompassed by the crowded prior art, which have been developed for the fulfillment of countless objectives and requirements.

Known prior art includes U.S. Pat. No. 4,469,250, which teaches a squeezable dispensing bottle for dispensing flowable material from a collapsible bladder held within a flexible container. U.S. Pat. No. 5,275,311 teaches a tool for applying viscous, creamy or pasty materials with an inner collapsible envelope and an outer deformable envelope capable of regaining its original shape through the agency of a check valve to allow the dispensed volume of material to be replaced by air between the inner and outer envelope. U.S. Pat. No. 5,305,920 teaches an applicator for dispensing viscous material with an inner collapsible container and an outer flexible container that also includes a means to invert the inner container upon itself about its midsection to allow for a greater portion of the inner container's contents to be used. U.S. Pat. No. 5,529,213 teaches another squeezable dispenser using an collapsible container and an outer flexible container which includes an improved pump to dispense the viscous material and to replace its volume with air between the inner and outer containers. U.S. Pat. No. 5,957,606 teaches a dispenser for liquid grout and is not suitable for viscous, creamy or pasty materials.

Also known in the art is the use of a pastry bag for applying a flowable material such as cake frosting, sugar paste or grout. In addition, tubes of viscous material are used with a caulk gun or cookie press apparatus are also generally known.

While these devices fulfill their respective, particular objectives and requirements, the aforementioned patents and prior art do not disclose a new grout and mortar bottle. The prior art focuses on methods of dispensing a viscous material in a manner that requires a separation of the material from the air. This requirement has necessitated the use of collapsible bladders, envelopes, or piston tubes. The flexible bottle exterior is generally used to contain the collapsible bladder and a volume of air that transmits the force exerted on the flexible exterior via air pressure to the collapsible bladder thus forcing the viscous material out of the application nozzle. The inventive device does not employ any inner bladder container and has additional advantages over the prior art including the ability to quickly and conveniently add any additional portion of viscous material, an intuitive method of handling the application tool, a replaceable dispensing orifice that allows for a variety of application nozzles, a container design that would allow the user to mix the viscous material within the container and a sensible simple design that would be durable and easy to maintain.

In these respects, the grout and mortar bottle according to the present invention substantially departs from the conventional concepts and designs of the prior art, and in so doing provides an apparatus primarily developed for the purpose of a more convenient handling and application of grout and mortar.

SUMMARY OF THE INVENTION

In view of the foregoing disadvantages inherent in the known types of grout and mortar application tools now present in the prior art, the present invention provides a new grout and mortar bottle construction wherein the same can be utilized for more convenient handling and application of grout and mortar.

The general ease of grout and mortar application of the present invention, which will be described subsequently in greater detail, is to provide a new grout and mortar bottle apparatus and method which has many of the advantages of the grout and mortar application tools mentioned heretofore and many novel features that result in a new grout and mortar bottle which is not anticipated, rendered obvious, suggested, or even implied by any of the prior art grout and mortar application tools, either alone or in any combination thereof.

To attain this, the present invention generally comprises a flexible container designed to hold a quantity of viscous material a rigid handle incorporated into the neck end with a coupling means that is capable of accepting a variety of application nozzles. The container is capped on the end opposite the applicator nozzle with an access cap containing a check valve for allowing the passage of air into but not out of the container for replacing the volume of dispensed material with air and allowing the flexible portion of the container to return to its original shape.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for a more convenient handling and application of grout and mortar of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new grout and mortar bottle apparatus and method which has many of the advantages of the grout and mortar application tools mentioned heretofore and many novel features that result in a new grout and mortar bottle which is not anticipated, rendered obvious, suggested, or even implied by any of the prior art grout and mortar application tools, either alone or in any combination thereof.

It is another object of the present invention to provide a new grout and mortar bottle, which may be easily and efficiently manufactured and marketed.

It is a further object of the present invention to provide a new grout and mortar bottle, which is of a durable and reliable construction.

An even further object of the present invention is to provide a new grout and mortar bottle which is susceptible of a low cost of manufacture with regard to both materials and labor, and which accordingly is then susceptible of low prices of sale to the consuming public, thereby making such grout and mortar bottle economically available to the buying public.

Still yet another object of the present invention is to provide a new grout and mortar bottle, which provides in the apparatuses and methods of the prior art some of the advantages thereof, while simultaneously overcoming some of the disadvantages normally associated therewith.

Still another object of the present invention is to provide a new grout and mortar bottle for more convenient handling and application of grout and mortar.

Yet another object of the present invention is to provide a new grout and mortar bottle, which includes an intuitively obvious method of operation.

Still yet another object of the present invention is to provide a new grout and mortar bottle that offers versatility of use by including a connector for a variety of applicator tools.

Even still another object of the present invention is to provide a new grout and mortar bottle that may be easily carried in a manner that would make the device ready to use.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
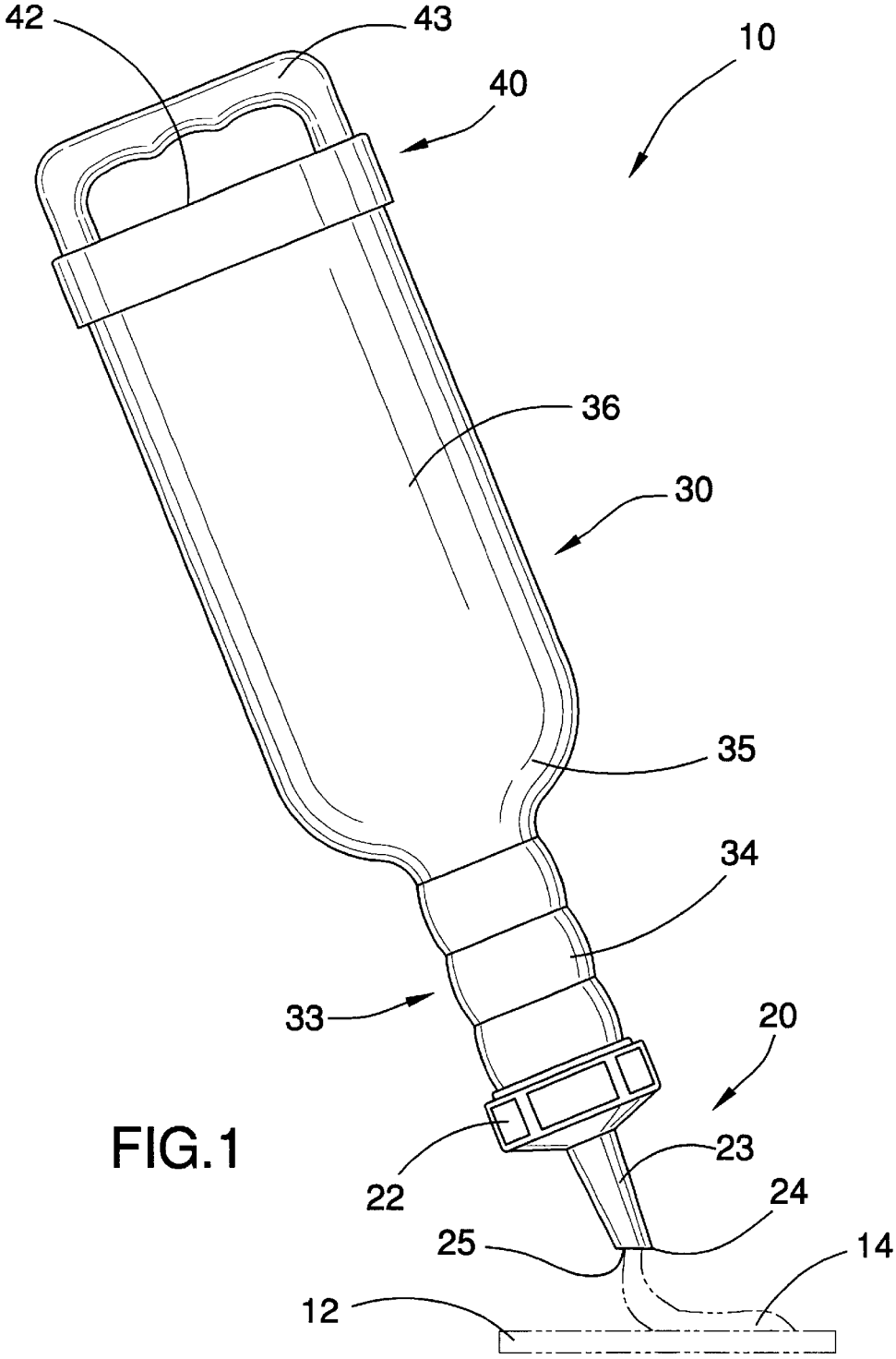
FIG. 1 is a profile view of a new grout and mortar bottle in use according to the present invention.

With reference now to the drawings, and in particular to FIGS. 1 through 4 thereof, a new grout and mortar bottle embodying the principles and concepts of the present invention and generally designated by the reference numeral 10 will be described.

As best illustrated in FIGS. 1 through 4, the grout and mortar bottle 10 generally comprises three sections. The first section is a dispensing section 20, the second section is a main section 30, and the third section is a cap section 40.

Figure 2:
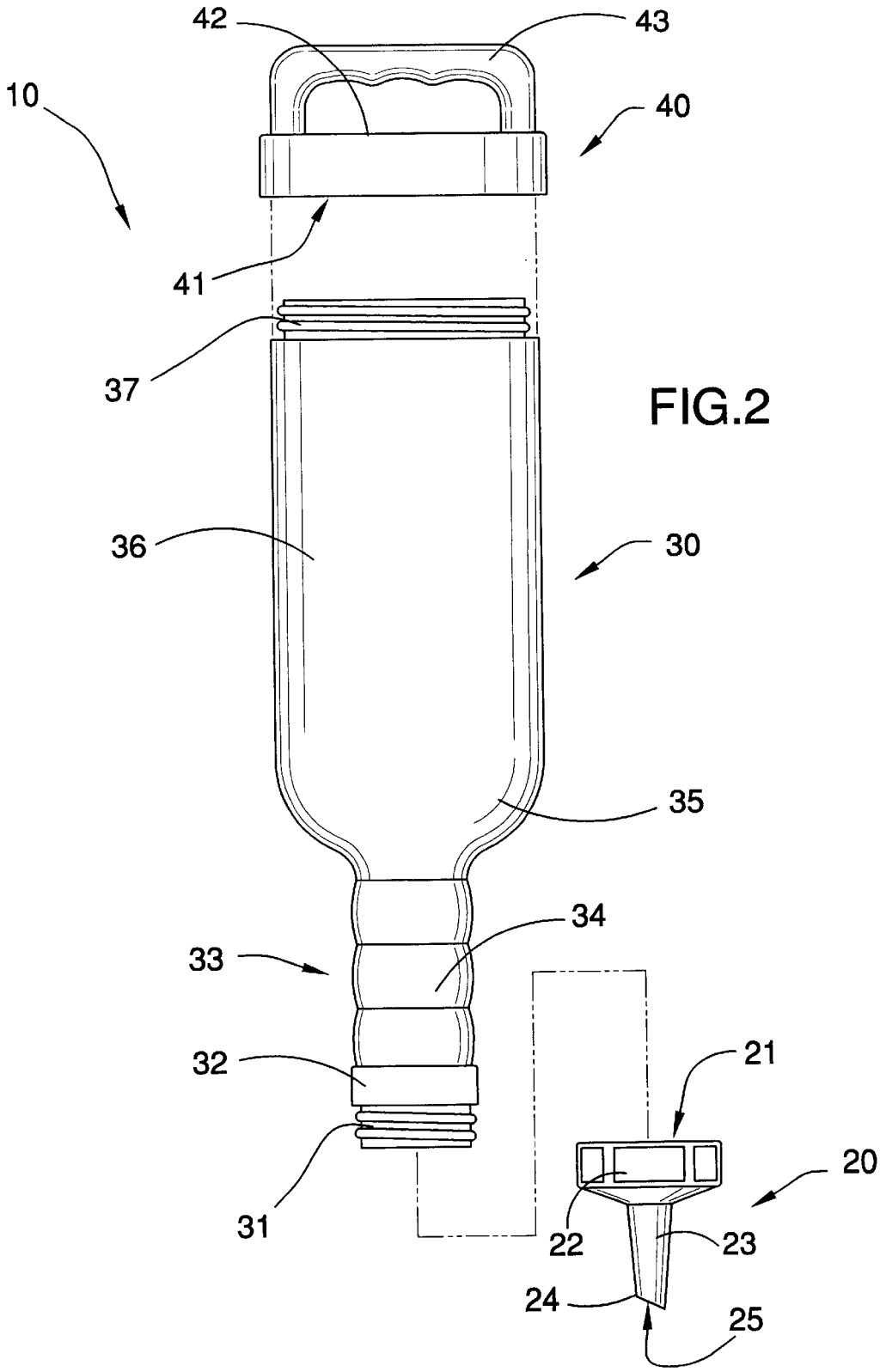
FIG. 2 is an exploded view of the removable parts of the present invention.
Figure 3:
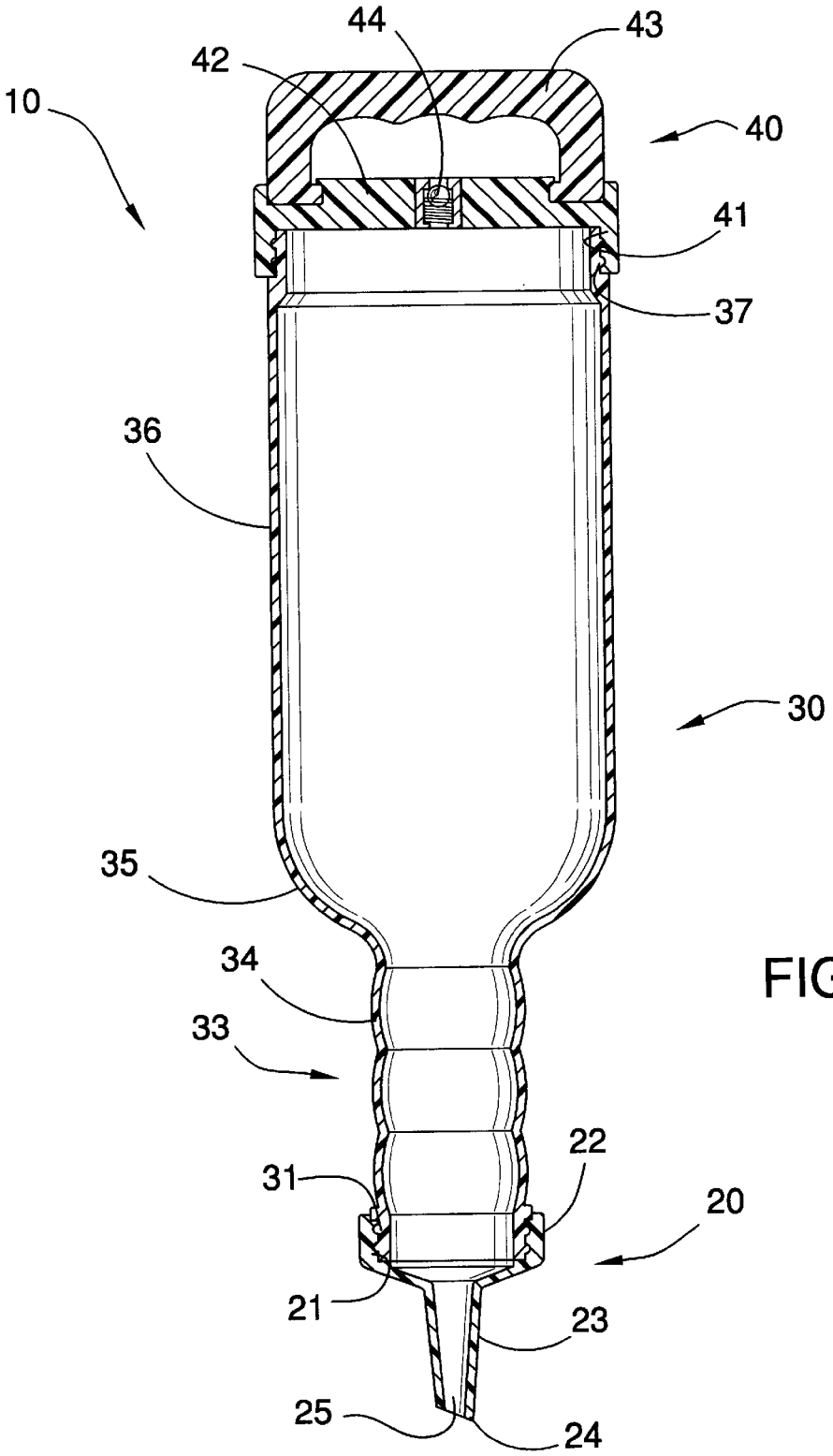
FIG. 3 is a cross-sectional view of the present invention.
Figure 4:
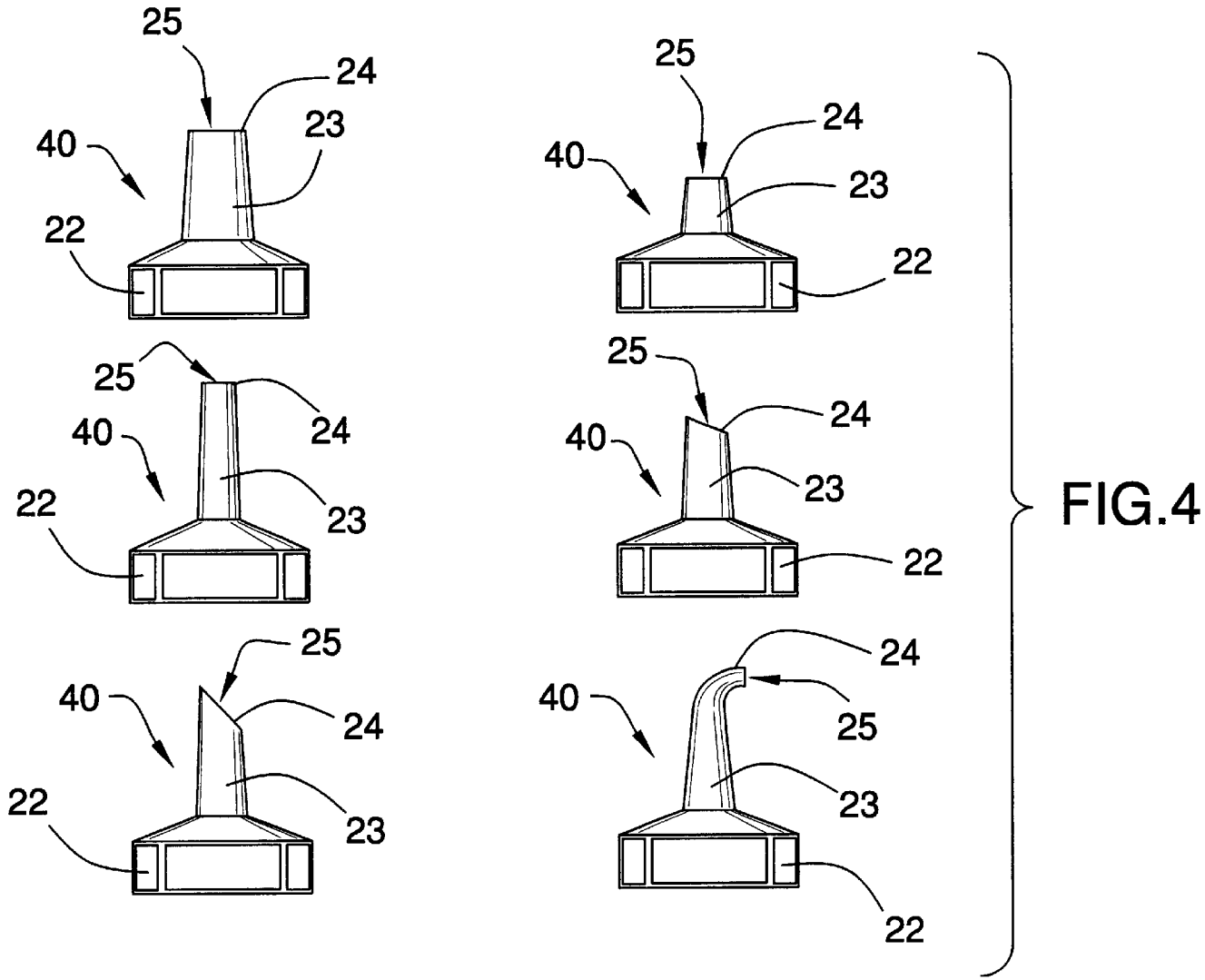
FIG. 4 is a profile view of a variety of applicator tools that may be used as part of the present invention.

For the purposes of general reference, the sections will be referred as having a top and bottom orientation in accordance with the posture of use. FIGS. 1 through 3 conform to this convention. Therefore, the application tip 24 of the dispenser section 20 would comprise the bottom and the first dispenser coupling device 31 would comprise the top of the dispenser section 20. The second dispenser coupling device 31 of the main section 30 would comprise the bottom and the second cap coupling device 37 would comprise the top of the main section 30. The first cap coupling device 41 of the cap section 40 would comprise the bottom and the handle 43 would comprise the top of the cap section 40.

The grout and mortar bottle is designed for the application of a viscous, creamy or pasty flowable substance which may include, but is not limited to, mortar, grout, spackling compound, drywall board and cement board filler, adhesives, plaster, sealants, solvents, cleaners, insulating foam, cake frosting, pancake batter, soft cookie dough, tooth paste, ointments, etc. This viscous, creamy or pasty flowable substance will hereafter be referred to as mud 14.

The dispenser section may comprise a hollow conduit for funneling the mud 14 from the main section 30 to the surface 12 to which the mud 14 is to be applied.

The dispenser section may comprise a first dispenser coupling device 21 which may be designed to attach to and mate with the second dispenser coupling device 31 of the main section 30. The illustrations depict the coupling devises 21 and 31 as threaded screw fasteners but the invention is not so limited. For example, the coupling devices may take various forms. The coupling device may take the form of a bayonet mount, as is employed in child-proof lids. The coupling device may take the form of a tension ring, as is employed in pressure hose connections. The coupling device may take the form of a pair of nested ends connected with a hinge on one side and a latch on the other, as is employed with re-sealable canning jars. The coupling device may take the form of nested ends joined by a deformable collar which conforms to the shape of the end without with collar, as is employed with TUPPERWARE™ or RUBBERMAID™ lids. It is appreciated by those of skill in the art that the coupling device could take a plurality of forms and is not limited to any of the examples given here.

The dispenser gripping ring 22 is located on the outside of the first dispenser coupling device for holding the dispenser section while connecting the two coupling devices 21 and 31. The gripping ring 22 may be comprised of a rigid structure with an outer surface shaped or textured to provide a non-slip grip. The illustrations depict a hexagonal shaped gripping ring comprised of six equally spaced surfaces that would be ideal for gripping by the user's hand, or with a crescent wrench, but the invention is not so limited. The shape or texturing of the gripping surface may take a variety for forms as is demonstrated in the art of jar lids, bottle caps, can covers, etc.

A nozzle 23 may be designed in a variety of shapes related to bore widths to allow for the viscosity and/or method of application desired. For example, a very thick mud 14 may require a large bore to move the substance through the nozzle 23, while a very thin mud 14 may require a small bore to assure that the mud 14 does not leak out. The shape of the nozzle 23 may also relate to the method of application of the mud 14. For example, if the application tip 24 must fit within or in between bricks the nozzle must be of sufficient length and narrowness to reach the surface 12 while avoiding the obstructions. It may be necessary to view or maneuver the application tip 24 while in use, and thus require a curved nozzle.

The application tip 24 may also be designed in a variety of shapes to conform to the type of mud 14 or the specific method of application desired. For example, an application tip 24 that is perpendicular to the length of the grout and mortar bottle 10 may work well in filling holes because the bottle 10 is placed on top of the hole perpendicularly, but in the case of laying a bead of mud 14 around a seam, it may be beneficial to design the tip at a 45 degree angle to the grout and mortar bottle 10 so that the user can guide the application tip 24 along the seam with the bottle 10 and view the flow of the mud 14. The application tip 24 may also vary the shape of the orifice 26 to produce certain effects when applying mud 14. For example, the hole filling orifice 25 may only require a simple circle but if the user desires air pockets to remain in the filling mud 14, a star patterned orifice 25 may be employed. An orifice 25 for laying a bead of mud 14 may be an elongated oval or a rectangular slit to direct the bead longitudinally. To provide decorative texture to the mud 14 for plastering or trimming brickwork, an orifice 25 with a serrated or jagged edge may be employed.

The main section 30 may comprise a hollow conduit with a number of functional portions. At the bottom end of the main section there may be a second dispenser coupling device 31 to couple to the first dispenser coupling device 21 of the dispenser section 20. The main section may include a neck gripping ring 32 located above the second dispenser coupling device. The neck gripping ring 32 is similar to the gripping ring 22 of the dispenser section 20 and is used to grip the main section when coupling or decoupling the dispenser section 20 from the main section 30. This is especially beneficial if the main section is devoid of a neck 33 or a hand grip 34 portion.

The neck 33 of the main section may be included for the purpose of providing a narrow section to allow the user to conveniently hold the grout and mortar bottle 10. The neck is similar in design to the neck of common bottles. The neck 33 may include texturing or a sleeve to act as a hand grip 34. The hand grip 34 may be disposed on the neck 33 to provide a better gripping surface for the user to hold.

A funnel 35 may link the flexible portion 36 to one of the portions of the main section, such as the neck 33, the neck gripping ring 32 and the second dispenser coupling ring 31, depending on the specific design desired. The funnel 35 would connect the larger flexible portion 36 to the aforementioned smaller portions 33, 32 or 31.

The flexible portion may comprise the main containment area for the mud 14 within the interior of the bottle. The flexible portion may be constructed from a resilient but flexible material such as plastic that could be deformed by use of force and then return to its original shape when that force was removed.

The second cap coupling device 37 may be designed to attach to and mate with the first cap coupling device 41 of the cap section 40. The second cap coupling device portion of the main section would have sufficient rigidity to accommodate the coupling apparatus. This pair of coupling devices 37 and 41 would be similar to coupling devices 21 and 31 in their function and variety of forms.

The cap surface 42 may be designed to close and seal the interior of the main section 30. The cap surface 42 may be disposed with a check valve 44 to allow the passage of air into but not out of the main section 30.

A handle 43 may be attached to the upper side of the cap surface 42. Such a handle 43 may be used to depend the grout and mortar bottle 10 in an orientation that would maintain its usability in that the mud 14 would be disposed in the bottom end. The handle 43 may also be used in coupling or decoupling the cap section 40 from the main section 30. The handle may be an integrated part of the cap section 40, or alternatively be flexibly or hingably attached thereto. The handle 43 may be constructed from a rigid or flexible material in accordance to its' design and use. The handle 43 may be attached at one or more locations on the cap surface 42. The handle 43 may be permanently attached or designed to be removable.

In use, the user may select a dispenser section 20 from a variety of dispenser sections 20 designed with various bore sizes, nozzle configurations and orifice patterns as is required for the intended use. The dispenser section 20 may then be attached to the main section 30 by coupling the first dispenser coupling device 21 of the dispenser section 20 to the second dispenser coupling device 31 of the main section 30. During the connecting process, the user may hold the dispenser section 20 by the gripping ring 22 and the main section 30 by the neck gripping ring 32 or by the hand grip 34 disposed on the neck 33 of the main section 30.

The grout and mortar bottle may be held in its position of use, with the dispenser section pointed down so that the mud 14 could then be transferred to the interior of the main section 30. It is an added benefit of the design of the interior of the main section 30 that sufficient room and access is available to mix the mud substances within the main section 30 instead of relying on a secondary mixing container. It is also an additional benefit of the design that the user can control the amount of mud to be transferred instead of being limited to the mud container packages.

When the appropriate amount of mud has been transferred or mixed in the interior of the main section 30, the cap section 40 is coupled to the main section 30 through use of the first cap coupling device 41 of the cap section 40 coupling with the second cap coupling device 37 of the main section in a manner similar to connecting the dispensing section 20 with the main section 30 via the coupling devices 21 and 31 as described above. The grout and mortar bottle is then ready to be used.

Once sealed, the weight of the mud 14 flowing down towards the orifice 25 will create negative pressure in the interior of the main section 30. This negative pressure will be sufficient to halt the flow of the mud from leaking out the orifice but it will not be so great as to deform the flexible portion 36 of the main section 30 or to open the check valve of the cap section 40.

The user may then direct the application tip 24 of the dispenser section 20 to the surface 12 using the handle 43 and/or the neck 33 or hand grip 34. With the application tip 24 directed on or towards the surface 12, the user may then squeeze the flexible portion 36 of the main section 30 to deform the flexible portion 36 to create positive pressure in the interior of the main section 30. The pressure would force the mud 14 down the funnel 35, and/or neck 33 of the main section and into the dispenser section 20. The continued pressure would keep the mud 14 flowing into the nozzle and out of the orifice 25 and onto the surface 12.

When sufficient mud 14 had been applied to the surface or when the flexible portion 36 has reached the limits of its deformation, the user may stop squeezing the flexible portion 36 and allow the flexible portion 36 to re-conform to its previous shape. The force of the flexible portion 36 re-conforming will produce sufficient negative pressure within the interior of the main section 30 to open the check valve 44 and allow air to replace the volume of mud extruded out the orifice 25 of the dispenser section 20. The process of squeezing the mud out and replacing the volume with air can continue until all the mud has been expended.

Between jobs, the user can hang the grout and mortar bottle 10 on his belt, a hook or other suspending device using the handle 43. Allowing the grout and mortar bottle 10 to maintain this orientation will assure that the mud 14 is lying toward the bottom of the bottle 10 and ready to use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool for dispensing a viscous flowable substance to a surface comprising:

a bottle having an interior for holding the viscous flowable substance until the substance exits the bottle, an orifice through which the viscous flowable substance exits the interior of the bottles, an access portal for loading the viscous flowable substance into the interior, a flexible section for being compressed to force the viscous flowable substance to flow out of the interior through the orifice;

an elongated neck portion extending between said orifice and a main portion of said bottle for forming a gripping portion adjacent to said orifice for facilitating gripping of said bottle by a user to manipulate the bottle while dispensing said viscous flowable substance, said neck portion having a cross-sectional area less than a cross-sectional area of said main portion;

the bottle having a removable dispensing section with the orifice thereon and including a nozzle for directing the flow of the viscous flowable substance and an applicator tip for controlling the shape of the viscous flowable substance exiting the orifice;

the bottle having a removable cap section with the access portal thereon and a portal to allow the inflow of air;

wherein the cap end includes a second gripping portion.

* * * * *